United States Patent [19]

Labelle

[11] Patent Number: 4,633,927

[45] Date of Patent: Jan. 6, 1987

[54] BARREL RINGS

[75] Inventor: H. M. Robert Labelle, Cornwall, Canada

[73] Assignee: Martinray Industries Ltd., Cornwall, Canada

[21] Appl. No.: 573,674

[22] Filed: Jan. 25, 1984

[30] Foreign Application Priority Data

Mar. 31, 1983 [CA] Canada ..... 425057

[51] Int. Cl.[4] ..... E06B 9/171

[52] U.S. Cl. ..... 160/133; 29/110; 29/125

[58] Field of Search ..... 29/110, 125; 160/382, 160/383, 133

[56] References Cited

U.S. PATENT DOCUMENTS

| | | | |
|---|---|---|---|
| 1,345,447 | 7/1920 | Johnson | 160/133 |
| 1,776,119 | 9/1930 | Johnson | 160/383 |
| 3,808,658 | 5/1974 | Looney | 29/110 |
| 4,158,128 | 6/1979 | Evdokimov et al. | 29/110 |

FOREIGN PATENT DOCUMENTS

| | | | |
|---|---|---|---|
| 1055796 | 4/1959 | Fed. Rep. of Germany | 160/133 |
| 435619 | 9/1935 | United Kingdom | 160/133 |
| 1207803 | 10/1970 | United Kingdom | 29/110 |

*Primary Examiner*—Ramon S. Britts
*Assistant Examiner*—Cherney S. Lieberman
*Attorney, Agent, or Firm*—Charles E. Brown; Charles A. Brown

[57] ABSTRACT

A barrel ring for use in rolling closures comprising at least two ring sections. One of the ring sections defines a part-circular outer surface. Another of the ring sections defines a part-spiral outer surface. The ring sections are joined together end-to-end to form a barrel ring with the part-spiral surface, at one end, merging smoothly into the part-circular surface.

A method for producing the barrel ring is also disclosed.

6 Claims, 5 Drawing Figures

BARREL RINGS

BACKGROUND OF THE INVENTION

1. Field of the Invention

This invention is directed toward an improved barrel ring and to a method for making the improved barrel ring.

2. Description of the Prior Art

Barrel rings are ring-shaped members used in the rolling closure art. Previously, rolling closures were rolled or wound up on a large diameter drum or barrel. The drum however was very heavy and thus difficult to rotate. Barrel rings were developed to replace the drum. The barrel rings are mounted at longitudinally spaced-apart locations on a small diameter support or axle. The outer surfaces of the rings provide the surface on which a closure can be wound. The rings and axle construction is much lighter than the drum construction previously used and thus less effort is needed to wind up the closure. However the barrel rings were one-piece cast members which made them quite expensive.

SUMMARY OF THE INVENTION

It is the purpose of the present invention to provide improved barrel rings which are much less expensive than known barrel rings. It is another purpose of the present invention to provide a method for manufacturing inexpensive, improved, barrel rings. In accordance with the present invention the improved barrel rings are composed of ring sections, the required number of which are joined together end-to-end to form a complete barrel ring. The sections are formed from one or more extruded members, each having a profile of the desired ring section. The extruded members are transversely cut into thin pieces which form the ring sections. Forming the ring sections from an extruded member results in the manufacture of a much cheaper barrel ring than if the ring were cast in one piece. Using extruded ring sections to form a complete barrel ring, instead of using an extruded ring further reduces the cost since an arc profile is cheaper to extrude than a tubular profile. The barrel rings formed from the sections of the extruded member are also lighter than the cast barrel rings, making the closure still easier to operate.

Preferably, each barrel ring is made from two ring sections. One of the ring sections has a part-circular outer surface on which the closure is mounted, and the other ring section has a part-spiral outer surface on which the closure is mounted. The two sections are joined end-to-end to form a barrel ring with the spiral surface, at one end, smoothly merging into the circular surface. The ring sections are assembled into barrel rings on the support or axle at longitudinally spaced-apart locations.

The invention is particularly directed toward a barrel ring for use in rolling closures comprising at least two ring sections. Each ring section has first outer means for use in receiving a closure thereon, second inner means for use in mounting the section on a support, and connecting means at each end of the section. Means are provided for fastening the sections together end-to-end to form the ring.

Preferably, the outer means of the ring sections includes a part-cylindrical, receiving surface and the inner means includes a part-cylindrical mounting surface. In at least one of the sections, the receiving and mounting surfaces are concentric. In at least one of the other sections, the receiving and mounting surfaces are nonconcentric.

In another embodiment of the invention, a barrel ring is provided for use in rolling closures which ring comprises at least two ring sections with one ring section having an outer, closure-receiving, spiral surface and the other ring section having an outer closure-receiving, cylindrical surface. Means are provided for joining the ring sections together end-to-end to form the ring with the spirl surface, at one end, merging with the cylindrical surface.

The invention is further directed toward a closure mounting comprising an elongated support and at least two ring sections mounted on the support, transverse to the longitudinal axis of the support, at each of a plurality of longitudinally spaced-apart locations on the support.

The invention is also particularly directed toward a method for use in manufacturing a barrel ring consisting of two or more ring sections comprising extruding a rigid member having a profile of the desired ring section, and cutting the rigid member transversely into pieces forming the ring sections.

BRIEF DESCRIPTION OF THE DRAWINGS

The invention will now be described in detail having reference to the accompanying drawings in which.

DESCRIPTION OF THE PREFERRED EMBODIMENTS

Figure 1:
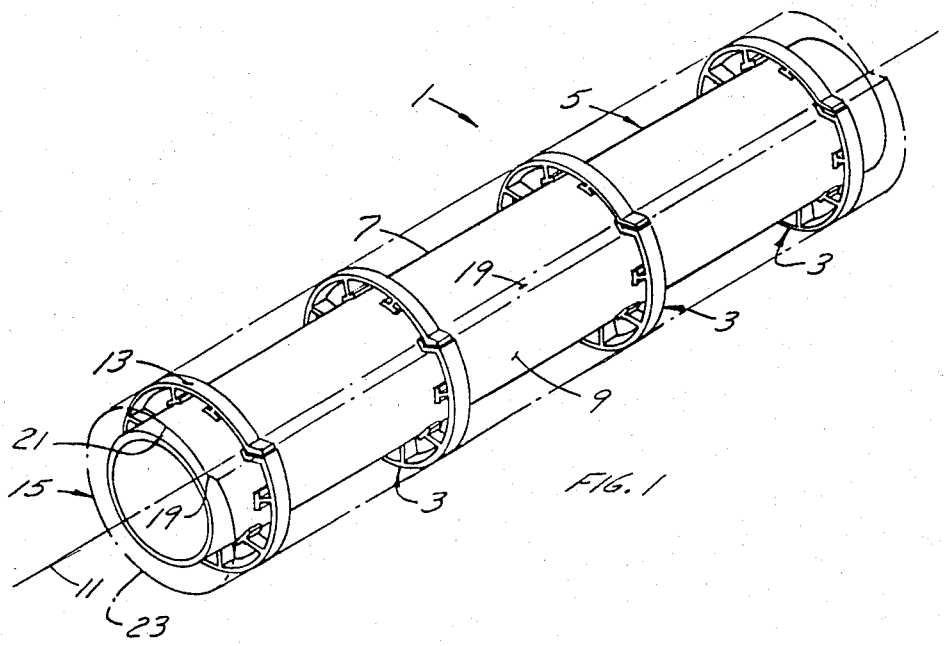
FIG. 1 is a perspective view of a rolling closure, wind-up mounting employing the barrel rings of the present invention.

The closure mounting 1 for a rolling closure, in accordance with the present invention, comprises barrel rings 3 mounted on a small diameter axle or support 5 as shown in FIG. 1. The support 5 in turn is rotatably mounted at its ends to fixed supports (not shown). The support 5 comprises a cylindrical tube 7 having a cylindrical outer surface 9. The barrel rings 3 are mounted on the outer surface 9 of the tube 7 at longitudinally spaced-apart locations, each ring 3 extending perpendicular to the longitudinal axis 11 of the tube 7.

Figure 2:
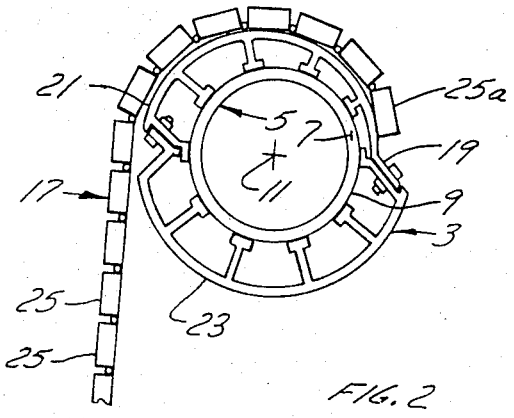
FIG. 2 is an end view of the mounting shown in FIG. 1 showing a closure mounted thereon.

The outer surfaces 13 of the barrel rings 3 generally define an imaginary tubular surface 15 on which a rolling closure 17 may be wound as shown in FIG. 2. The imaginary surface 15 has a step 19 extending parallel to the tube axis 11. A part-spiral imaginary surface 21 starts from the bottom of step 19 and forms about half the tubular surface 15. The spiral surface 21 merges into a part-cylindrical surface 23 which forms the other half of the tubular surface 15. The part-cylindrical surface 23 ends at the top of step 19.

The rolling closure 17 comprises a plurality of sections or slats 25 which are hingedly joined to each other along their adjacent long edges, one after the other. The first slat **25*a* of the closer 17 extends across the rings 3, parallel to the axis 11 of the support tube 7. This first slat 25*a* rests on the surfaces of the rings 3 defining the part-spiral surface 21 and adjacent the step 19. The slat 25***a* is connected to the rings 3, and the remainder of the closure 17 is wound onto the rings 3 when the support tube 7 is rotated. The step 19 allows the closure 17, when being wound, to pass smoothly off the part-cylindrical surface 23 onto the first slat 25*a*.

Figure 3:
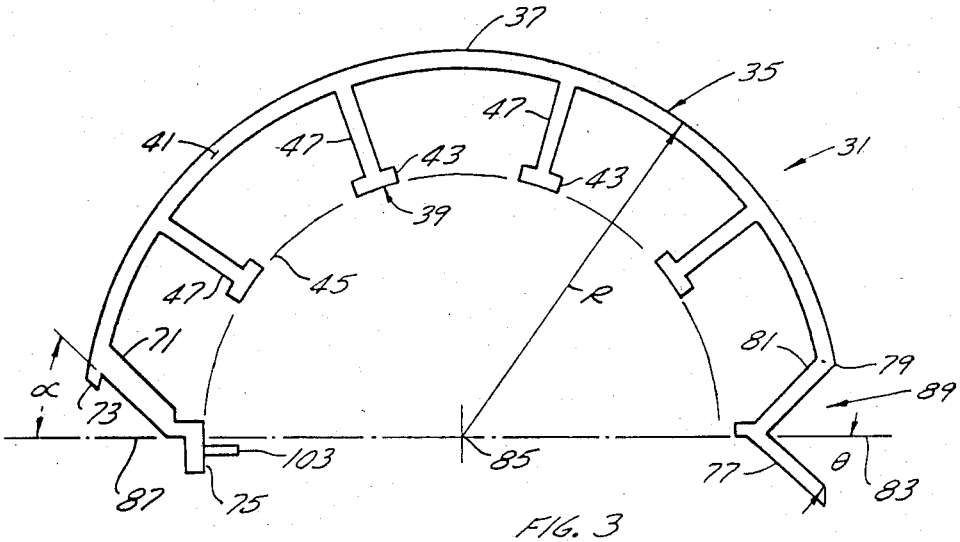
FIG. 3 is an end view of one barrel ring section.

Each barrel ring 3 preferably comprises two ring sections 31, 33, each ring section 31, 33 forming about one half the ring 3. One of the ring sections 31, as shown in FIG. 3, has first outer means 35 defining an outer, part-circular closure receiving surface 37, and second inner means 39 for use in mounting the ring section 31 on the support tube 7 with surface 37 concentric with the outer surface 9 of the support tube 7. The first means 35 comprises a strip 41 of rigid material curved to have its outer surface form the part-circular, closure receiving surface 37. The second inner means comprises a plurality of mounting pads 43 radially spaced-apart along a part-circular arc 45 within and concentric to outer, part-circular surface 37. Arc 45 has substantially the same radius as the radius of the cylindrical surface 9 of the support tube 7. Each pad 43 is connected to strip 41 by a radial arm 47.

The other ring section 33, as shown in FIG, 4, has first outer means 49 defining an outer, part-circular closure receiving surface 51, and second inner means 53 for use in mounting the ring section 33 on the support tube 7 with surface 51 non-concentric with the outer surface 9 of the support tube 7. The first means 49 comprises a strip 54 of rigid material curved to have its outer surface form the part-circular, closure receiving surface 51. The second inner means 53 comprises a plurality of mounting pads 55 radially spaced-apart along a part-circular are 57 within surface 51. The arc 57 is not however concentric to surface 51. Instead, arc 57 is shifted relative to surface 51 so that one end 59 of strip 55 is much farther away from arc 57 than the opposite end 61 of strip 54 is from arc 57. The distance "D" from the center 63 of arc 57 to the outer surface 51 at the one end 59 of strip 55 is equal to the radius "R" of the surface 37 on the first ring section. A radial arm 65 connects each pad 55 to strip 54, the arms 65 radial to the center 63 of arc 57.

Means are provided on each end of the ring sections 31, 33 for connecting them together to form a barrel ring 3. In more detail, the one ring section 31, as shown in FIG. 3 has a first connecting wall 71 at one end 73 of strip 41. The wall 71 extends inwardly and away from the nearest radial arm 47. An elongated mounting pad 75 is provided at the end of wall 71 on arc 45. A second connecting wall 77 is provided at the other end 79 of strip 41. The second wall 77 is connected at its inner end to a support wall 81 which in turn connects to the end 79 of strip 41. The second wall 77 extends inwardly at an angle "$\theta$", to a radil line 3 from the center of curvature 85 of strip 41, toward the nearest radial arm 47. The angle "$\theta$" is equal to the angle "$\alpha$" at which the first wall 71 extends to an extension 87 of radial line 83. The support wall 81 preferably extends transversely from the second wall 77 to the end 79 of strip 41 and, together with the second wall 75, defines an outwardly opening notch 89.

Figure 4:
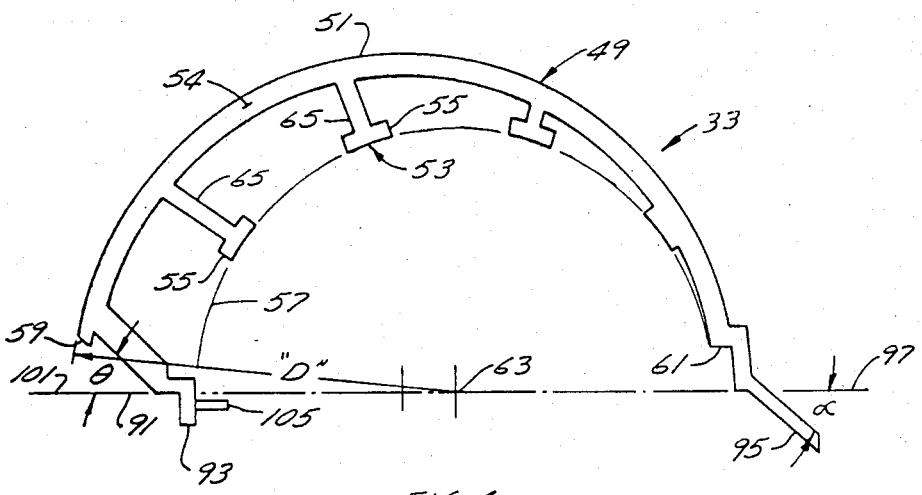
FIG. 4 is an end view of another barrel ring section.

The other ring section 33, as shown in FIG. 4, has a first connecting wall 91 at the one end 59 of strip 54 which wall 91 extends inwardly and away from the nearest radial arm 65. An elongated mounting pad 93 is provided at the inner end of all 91 on arc 57. A second connecting wall 95 is provided at the other end 61 of strip 54 which wall 95 extends upwardly and away from the nearest pad 55. The second connecting wall 95 extends at an angle "$\alpha$" to a radial line 97 extending from the center of curvature 63 of the arc 57. The first connecting wall 91 extends at an angle "$\theta$" to an extension 101 of radial line 97, the angle "$\theta$" preferably being equal to the angle "$\alpha$".

Figure 5:
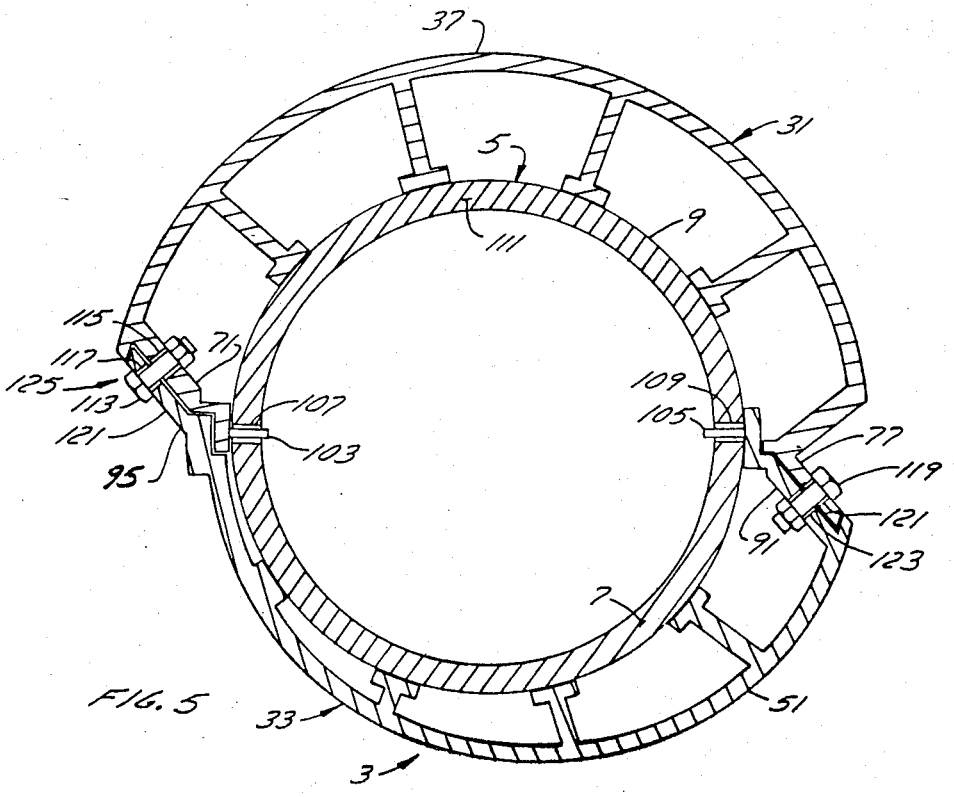
FIG. 5 is a cross-section view of a barrel ring mounted on the axle.

The ring 3 is assembled by joining the ring sections 31, 33 together end-to-end. The ring 3 is preferably assembled on support tube 7 as shown in FIG. 5. Means are provided to locate and retain each ring section 31, 33 on support tube 7. The locating and retaining means can comprise a pin 103 extending radially inwardly from the center of mounting pad 75 on ring section 31, and a pin 105 extending radially inwardly from the center of mounting pad 93 on ring section 33. A pair of substantially diametrically opposed holes 107, 109 in the wall 111 of support tube 7 receive the pins 103, 105 respectively when the ring sections 31, 33 are mounted end-to-end about support tube 7. When mounted on the support tube 7, the first connecting wall 71 on section 31 receives the second connecting wall 95 on section 33. The two walls 71, 95 are positioned side-by-side and a bolt 113 passes through aligned holes 115, 117 in the walls 71, 95 respectively to joing the walls 71, 95, and thus adjacent ends of the ring sections 31, 33, together. Similarly, second wall 77 on section 31 receives the first connecting wall 91 on section 33. The two walls 77, 91 are positioned side-by-side and a bolt 119, passing through aligned holes 121, 123 in the walls 77, 91, joins them together. Thus, the ring sections 31, 33 are assembled into a rigid ring 3 securely mounted on support tube 7 via locating pins 103, 105 and bolts 113, 119.

When assembled on support tube 7, each ring 3 has a shoulder or step 125 defined by outwardly extending connecting wall 95 on ring section 33. The steps 125 of all the rings 3 on the support tube 7 are aligned. The height of each step 125 is generally equal to the thickness of the slats 25 of the closure 17. The first slat 25*a* of the closure 17 is positioned across the rings 3 on the support tube 7 on the part-spiral surface 51 of the ring sections 33 and adjacent the steps 125 formed by the second connecting walls 95 on these sections 33. The first slat 25*a* is fastened to the rings 3 in this position by any suitable fastening means (not shown). The support tube 7 can then be rotated to wind the closure 17 on it with the slats 25 covering the rest of the part-spiral surfaces 51 on the ring sections 33 first, and then smoothly moving to cover the part-circular surfaces 37 of the other ring sections 31. As the closure passes steps 125 it begins to wind smoothly on the first circle of slats now on the rings 3.

In accordance with the present invention, each ring section 31, 33 is formed by first extruding a long, rigid member having the profile of the desired ring section 31, 33. Each member is then cut transversely into slices, each slice forming a complete ring section 31 or 33 except for the connecting holes 115, 117, 121, 123 and the locating pins 103, 105. Each ring section 31, 33 is made wide enough so that it sits on its pads in stable fashion on the outer surface of the support 5. Each section is completed by drilling holes 115, 121 in section 31 and fixing pin 103 to pad 75, and by drilling holes 117, 123 in section 33 and fixing pin 105 to pad 93. The ring sections 31, 33 are then joined end-to-end on support tube 7 to form the barrel rings 3 of the present invention.

While each barrel ring 3 has been described as being made from two ring sections, three or more sections could be employed in each ring. For example a ring could be made from three ring sections, each section providing about one-third the circumference of the ring. Two of the sections could be identical, providing part-circular mounting surfaces, and the other section could provide a part-spiral mounting surface. The ring sections could also be made in different sizes providing barrel rings of varying diameter.

I claim:

1. A barrel ring for use in rolling closures comprising: at least two extruded ring sections; each of the ring sections having an outer curved strip defining an outer curved surface for use in receiving a closure thereon, an inner curved strip defining an inner curved surface for use in mounting the section on a central support, at least one of the strips divided into segments separated by gaps, and only one cross-member joining each segment of the one strip to the other strip; one of the ring sections having its outer curved strip joined to its inner curved strip by cross-members that progressively increase in length; and fastening means fastening the ring sections together end-to-end to form the ring.

2. A barrel ring as claimed in claim 1 wherein the inner and outer surfaces on the one ring section are part-circular and non-concentric and wherein the inner and outer surfaces on the other ring sections are part-circular and concentric.

3. A barrel ring as claimed in claim 2 wherein the radius of the outer surface on the one ring section is different from the radius of the outer surface on the other ring sections.

4. A barrel ring for use in rolling closures comprising: at least two ring sections; one of the ring sections having a part-cylindrical outer surface for use in receiving a closure thereon and a part-cylindrical inner surface for use in mounting the section on a central support, the inner and outer surfaces being non-concentric; the other ring section or sections each having a part-cylindrical outer surface for use in receiving a closure thereon and a part-cylindrical inner surface for use in mounting the section on a central support, the inner and outer surfaces being concentric; the part-cylindrical inner surface on each section being formed by a plurality of circumferentially spaced-apart pads and the part-cylindrical outer surface on each section being formed by a curved strip of material, and wherein a radially extending rib connects each pad to its respective strip; and means for fastening the sections together end-to-end to form the ring.

5. A barrel ring for use in rolling closures comprising: two or more ring sections; each ring section having means defining an inner, part-cylindrical mounting surface having the same radius; one of the ring sections having an outer, part-spiral, closure receiving surface; the other ring section or sections having an outer, part-cylindrical, closure receiving surface; the means defining the closure receiving surface on each section being a unitary member, the means defining the mounting surface on each section comprising a plurality of circumferentially spaced-apart members, and a radially extending rib connecting each mounting surface member to the closure receiving member; and means for joining the ring sections together end-to-end to form the ring with the part-spiral outer surface on the one section merging with the part-cylindrical outer surface on one of the other sections.

6. A method for use in manufacturing a barrel ring consisting of: at least two extruded ring sections; each of the ring sections having an outer curved strip defining an outer curved surface for use in receiving a closure thereon, an inner curved strip defining an inner curved surface for use in mounting the section on a central support, at least one of the strips divided into segments separated by gaps, and only one cross-member joining each segment of the one strip to the other strip; one of the ring sections having its outer curved strip joined to its inner curved strip by cross-members that progressively increase in length; and fastening means fastening the ring sections together end-to-end to form the ring; said method comprising the steps of: extruding a first rigid member having the profile of said one of the ring sections; extruding a second rigid member having the profile of the other ring sections; transversely cutting at least one narrow slice off of each rigid member to form said one and other ring sections; and connecting said ring sections together end-to-end with said fastening means to form the barrel ring.

* * * * *